US010384218B2

(12) United States Patent
Mezhericher et al.

(10) Patent No.: US 10,384,218 B2
(45) Date of Patent: Aug. 20, 2019

(54) LIQUID ATOMIZATION METHOD AND DEVICE

(71) Applicant: Sami Shamoon College of Engineering (R.A.), Beer Shiva (IL)

(72) Inventors: Maksym Mezhericher, Beer Sheva (IL); Izhak Ladizhensky, Beer Sheva (IL); Isaac Etlin, Ashdod (IL)

(73) Assignee: Sami Shamoon College of Engineering (R.A.), Beer Sheva (IL)

( * ) Notice: Subject to any disclaimer, the term of this patent is extended or adjusted under 35 U.S.C. 154(b) by 81 days.

(21) Appl. No.: 15/324,902

(22) PCT Filed: Aug. 27, 2015

(86) PCT No.: PCT/IL2015/050857
§ 371 (c)(1),
(2) Date: Jan. 9, 2017

(87) PCT Pub. No.: WO2016/055993
PCT Pub. Date: Apr. 14, 2016

(65) Prior Publication Data

US 2017/0203312 A1 Jul. 20, 2017

(30) Foreign Application Priority Data

Oct. 7, 2014 (IL) ..... 235083

(51) Int. Cl.
*B05B 7/04* (2006.01)
*B05B 17/04* (2006.01)
(Continued)

(52) U.S. Cl.
CPC ..... *B05B 7/0416* (2013.01); *B05B 1/005* (2013.01); *B05B 1/207* (2013.01); *B05B 7/0012* (2013.01); *B05B 7/02* (2013.01); *B05B 17/04* (2013.01)

(58) Field of Classification Search
CPC ..... B05B 7/0416; B05B 7/0012; B05B 1/005; B05B 1/207
(Continued)

(56) References Cited

U.S. PATENT DOCUMENTS 3,378,238 A * 4/1968 Babington ..... F24F 6/04 126/113
3,584,792 A * 6/1971 Johnson ..... B05B 7/00 128/200.21
(Continued)

FOREIGN PATENT DOCUMENTS

CS 208843 B1 10/1981
DE 4402758 A1 8/1995
(Continued)

OTHER PUBLICATIONS

International Search Report and Written opinion for PCT App. No. PCT/IL2015/050857 dated Dec. 2, 2015, 8 pgs.
(Continued)

*Primary Examiner* — Alexander M Valvis
*Assistant Examiner* — Qingzhang Zhou
(74) *Attorney, Agent, or Firm* — Michael A. Bondi; Moss & Barnett

(57) ABSTRACT

The invention provides a device and a method for liquid atomization, employing a hollow body with a closed surface perforated with a plurality of point orifices and connected to a compressed gas. The body is submerged in a liquid to be atomized, with some orifices immersed in the liquid and others emerged from it. The system can be scaled-up according to the need.

8 Claims, 8 Drawing Sheets

(51) Int. Cl.

| | |
|---|---|
| ***B05B 1/20*** | (2006.01) |
| ***B05B 7/00*** | (2006.01) |
| ***B05B 7/02*** | (2006.01) |
| ***B05B 1/00*** | (2006.01) |

(58) Field of Classification Search
USPC ..... 239/8, 338, 433, 566, 568; 261/77, 78.1, 261/78.2, 122.1
See application file for complete search history.

(56) References Cited

U.S. PATENT DOCUMENTS

| | | | | |
|---|---|---|---|---|
| 3,595,443 | A | 7/1971 | Jones | |
| 3,814,322 | A | 6/1974 | Waldrum | |
| 4,233,891 | A * | 11/1980 | Schindler | A47J 27/16 99/348 |
| 2012/0085239 | A1 | 4/2012 | Sonoda | |

FOREIGN PATENT DOCUMENTS

| | | | |
|---|---|---|---|
| FR | 1499843 | A | 10/1967 |
| GB | 775734 | | 5/1957 |

OTHER PUBLICATIONS

Extended European Search Report for European Application No. 15848995.5, dated Apr. 26, 2018, 11 pgs.

* cited by examiner

LIQUID ATOMIZATION METHOD AND DEVICE

FIELD OF THE INVENTION

The invention relates to a device and method for generating droplets of small sizes, which is also known as "atomization" of liquids. Liquid atomization is useful in many fields, such as engineering, chemistry, and medicine. The invention relates to all forms of liquids.

BACKGROUND OF THE INVENTION

Liquid atomization provides many advantages in various fields. One example of a field where the atomization of liquids increases the quality of products is the pharmaceutical industry. When a medicine is to be administered by spray, the size of each sprayed drop is a crucial factor regarding the efficiency of the medicine, since as the size of each drop is smaller, the medicine is better distributed on a surface, and can be absorbed evenly and more efficiently.

An even and high-quality distribution of materials can also be applied in the cosmetic field, where the spreading of a material needs to be as uniform as possible. It can also apply to sun-screening products for example, and of course in many other fields.

Another example of a field where liquid atomization can improve results is mechanic engineering, particularly regarding engines that operate by fuel. The fuel is injected as a spray of droplets into an engine combustion chamber, and smaller droplets provide more effective combustion as they have more developed surface for chemical reactions and transport phenomena, and thus the engine performance increases.

There are drop size reducing devices and methods that face the same main problem that needs to be solved—when the size of drops is reduced, the flow sufficiency decreases. This is because in most of the atomizing devices the droplets flow rate increases with the size of the orifice through which liquid is pushed to generate the droplets. Smaller orifices result in smaller droplets but reduce their flow rate.

Many known methods for liquid atomization use a device that functions as a centrifuge, which releases liquid through at least one nozzle while rotating. The rotation speed of such device and the size of the nozzle will determine the size of the drops of the released liquid. Apart from the main known problem of flow sufficiency, this method also suffers from the problem of lack of uniformity. The size of the drops, according to this method, is in direct relation to the speed of rotation of the device, and until the device reaches its desired speed, the size of the drops changes as long as the speed of rotation keeps changing. Moreover, the size distribution of droplets may range from very small to big droplets for the same speed of rotation.

Another example of a known method is the use of ultrasonic waves. When a liquid material is placed on a piezoelectric surface that is connected to electrodes, an electric voltage through the electrodes causes the piezoelectric surface to vibrate, and when the vibration is powerful enough to overcome the tension of the liquid surface, it forms the atomized drops. Although this method allows obtaining droplets of less than ten microns, it suffers from low droplet flow rates and high energy consumption.

Thus, the major drawbacks of the current methods for production of micron and submicron droplets include high atomization energy, high temperature and boiling of liquids, low atomization flow rates, wide distribution of droplet sizes, and poor scalability with low flexibility and controllability; moreover, sensitive materials, such as organic, pharmaceutical and biological, can be damaged by high temperatures or boiling, pressures, electric and/or magnetic fields and ultrasonic waves. Specific costs of atomization of submicron droplets, namely expenses on atomization per effective atomization flow rate, are thus too high. It is therefore an object of the invention to provide method and a device for producing atomized liquid with a relatively small size of drops, which overcomes the drawbacks of the prior art.

It is another object of the invention to provide a liquid atomizing device that is easily operated and easily maintained.

It is also an object of the invention to provide a low-cost liquid atomization system.

It is further an object of the invention to provide a liquid atomization method with a relatively low energy consumption.

Other objects and advantages of the invention will become apparent as the description proceeds.

SUMMARY OF THE INVENTION

The invention provides a liquid-atomization device, comprising a hollow body having a closed surface provided with a plurality of orifices, suitable to be partially submerged in a liquid while a part of the orifices are immersed in said liquid, under the interface between said liquid and a gas above it, and a part of the orifices are emerged from said liquid, said body being connected to a source of compressed gas and adapted to receive said compressed gas, the diameter and the number of the orifices being adapted to discharge desired flow rates of said gas out of the body, wherein the gas discharged from the immersed orifices results in a jet of liquid particles to the space above said interface where said particles form a film covering the emerged orifices, and wherein the gas discharged from said emerged orifices continuously transforms said film to liquid droplets smaller than said liquid particles, said droplets and the discharged gas forming a droplets flow. The average diameter of the droplets may be up to 10 μm in some applications or up to 8 μm or up to 6 μm or up to 4 μm or up to 2 μm or up to 1 μm. The hollow body has a closed surface, which means that its inner volume is separated from the outside space, and an outer liquid cannot penetrate into it—except for said orifices which are perforated on the surface; these orifices have a small size when compared with the size of the body; for example, the orifices may be smaller than 0.5 mm, whereas the body may be a tubing 200 mm long. The rules of hydrodynamics provide the means for selecting the parameters for every application, including the number of orifices, their surface density and their diameter, as well as the pressure of the compressed gas. Any available gas complying with the safety rules may be used. In one embodiment, the gas is selected from air, nitrogen, and aerosol propellants. The hollow body has preferably a shape selected from cylindrical, tubular, torroidal, spherical, and a combination thereof. The body is usually located in the liquid in a naturally floating position; the longitudinal axis of the cylindrical or tubular shape is parallel to said interface, the axis of the torroid is perpendicular to the interface. In some embodiments, the device includes a hollow body comprising one continuous inner volume, having one connection to the compressed gas. In some embodiments, the device comprises a plurality of parallel hollow bodies, each one connected to the source of compressed gas. In other embodiments, the device comprises a plurality of parallel hollow bodies, interconnected to each other, so that only one of them must be connected to the source of compressed gas. The atomization capacity may be enhanced by the size of said hollow body or by the number of parallel bodies. The hollow body may be made of any material compatible with the liquid to be atomized, and it may comprise polymers, metals, or composites. In a preferred embodiment of the invention, the hollow body is made of an elastic material. In one embodiment, the device according to the invention may comprise an additional means for generating bubbles in the liquid to be atomized in order to increase the amount of generated bubbles under said interface. The liquid and/or the compressed gas may be heated or cooled, in some applications. In one preferred embodiment, the device according to the invention comprises conducting means for narrowing and orienting said droplets flow to a desired shape and direction. The device preferably comprises regulation means including the means for adjusting the gas pressure which enters the hollow body, and the means for switching on and off the droplets flow out of the device. The size of the orifices is usually less than 1 mm. In some embodiments, the size of the orifices is less than 800 μm, or less than 700 μm, or less than 600 μm, or less than 500 μm, or less than 400 μm, or less than 300 μm, or less than 200 μm, or less than 100 μm, or less than 50 μm. The device of the invention may further comprise position means for regulating the relative position of said body and said interface, ensuring the desired ratio between the number of immersed and emerged orifices. Said position means may comprise floaters and/or weights affecting the degree of submersion of the body, or they may comprise sensors for regulating the amount of the liquid in which the body is submerged.

The orifices may be of a uniform structure, or they may form groups of different structures; for example, there may be two types of orifices, those intended to be immersed and those intended to be emerged. The device may have a form of a small aerosol spray or may have an industrial capacity of any scale. The source of the compressed gas may be an external source of any size being connected with the device; in some embodiments, the gas source may be a compact small gas source, such as a small gas container, which has a size compatible with the device.

The invention relates to a method for performing liquid-atomization, comprising: i) providing a container with an opening, and placing to said container a liquid to be atomized; ii) locating to said container a hollow body being partially submerged in said liquid, the body having a closed surface preferably selected from cylindrical, tubular, spherical or torroidal shape and being perforated with a plurality of orifices of which a part is immersed under the interface of the liquid and a gas above it, and a part emerged from the liquid, the body being connectable to a source of compressed gas and adapted to receive said compressed gas; iii) connecting the body with a source of compressed gas and allowing the gas to be discharged from the immersed and emerged orifices, the gas discharged from the immersed orifices causing a jet of liquid particles to the space above the interface where said particles form a film covering the emerged orifices, and wherein the gas discharged from said emerged orifices continuously disintegrates said film to liquid droplets smaller than said liquid particles; iv) collecting a stream of said droplets and the discharged gas from said narrow opening. Said narrow opening may act as an aerosol spray.

The invention is directed to a system for liquid-atomization comprising a) a container partially filled with a liquid to be atomized; b) a hollow body having a closed surface of a shape preferably selected from cylindrical, tubular, spherical, and torroidal and being perforated with a plurality of orifices, the body being connectable to a source of compressed gas and adapted to receive said compressed gas, the body being adapted to be inserted to said container and partially submerged under the interface of said liquid and a gas above it; c) a source of compressed gas connectable with said body; d) a position means for regulating the relative position of said body and said interface, ensuring the desired ratio between the number of immersed and emerged orifices, the position means comprising elements selected from floaters, weights, sensors, or a combination thereof; e) collecting means for shaping and orienting the droplets flow; and optionally f) a supplying means for continually supplying the liquid into the container.

BRIEF DESCRIPTION OF THE DRAWINGS

The above and other characteristics and advantages of the invention will be more readily apparent through the following examples, and with reference to the appended drawings, wherein.

DETAILED DESCRIPTION OF THE INVENTION

It has now been found that releasing pressurized gas to a liquid through the walls of a finely perforated elastic tubing, which is located near the interface of said liquid with the outer atmosphere, provides an efficient means for atomization of the liquid, wherein said tubing has a longitudinal axis which lies in a plane parallel to said interface, and wherein said tubing is partially immersed in the liquid, when the perforation is located partially in the immersed part and partially in the emerged part of the tubing.

Without wishing to be limited by any particular theory, the inventors believe that the bubbles formed in the immersed orifices of the perforation result in a flow of liquid particles to the space above the liquid-gas interface, where they form a thin film covering the emerged orifices of the perforation; the film is simultaneously produced and disintegrated on the orifices exposed to the atmospheric environment, continuously forming bubbles which burst in the flow of the pressurized gas released from the emerged orifices. Whatever the exact mechanism, the flow of the pressurized gas takes the tiny droplets up farther from the liquid surface, producing the desired spray.

The desired effect of liquid atomization according to the invention can be attained regardless the shape of the hollow body. The body has preferably a tubular shape, wherein a long tubing may be, for example, arranged near the liquid/air interface in various patterns, such as a circle, or folded to a zigzag shape more or less filling the plane of said interface, whereas the surface perforation is partially immersed and partially emerged. A plurality of bodies, their inner volumes either interconnected or separated, fill the interface plane to a predetermined degree.

Figure 3:
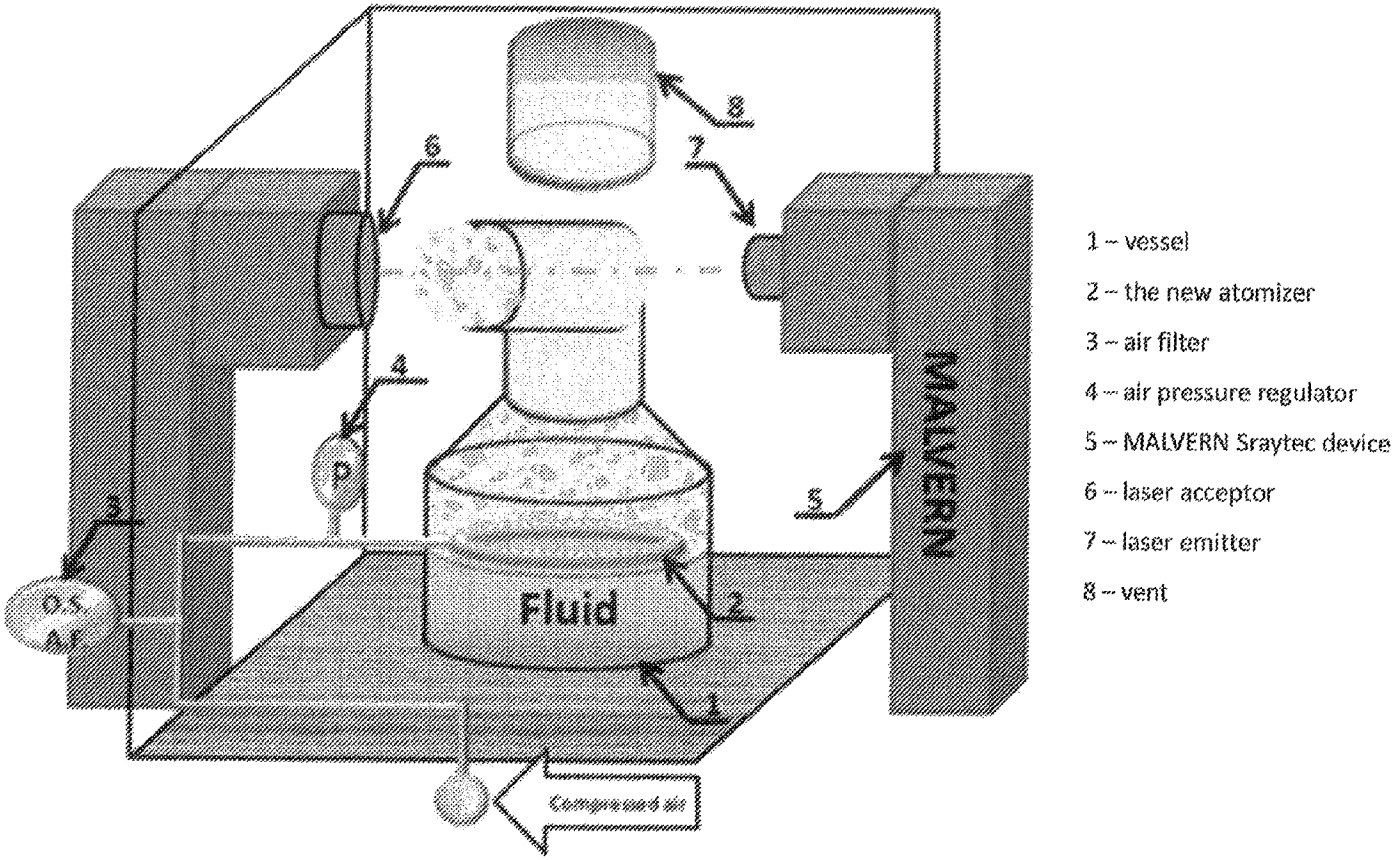
FIG. 3 is a schematically outlined perspective view of a device in one embodiment of the invention, in which the device comprises a hollow body shaped as a ring torus.

In one preferred embodiment, the hollow body has the shape of a ring torus (see FIG. 3). Ring torus is a surface of revolution generated by revolving a circle in three-dimensional space about an axis coplanar with the circle, wherein the axis of revolution does not touch the circle, The diameter of said circle, for the purpose of the invention, may be for example between 5 and 100 mm. The circumference of said ring, corresponding to the length of the tubing, will be selected in accordance with the required atomization output. For example, in one arrangement of the invention, a ring tubing having a tube diameter of about 10 mm (the diameter of the circle of said ring torus, which is the diameter of the cross-section of the tubing, perpendicular to the longitudinal axis of the tubing) and a total length of 1 meter (circumference of the ring torus) atomizes 1 liter water during 1 hour at the overpressure in the tubing of 1 atm. The ring torus is usually about half immersed and half emerged, the degree of immersion of the floating ring being easily regulated by attaching weights or floaters. In one preferred embodiment of the invention, the hollow body has a toroid shape created by revolving an oval instead of a circle, preferably by rotation of a very eccentric ellipse oriented by its long axis parallel to the axis of revolution; such toroid has larger surface than normal ring torus (for the same volume), and it can advantageously accommodate more orifices per one meter of the torus circumference.

In some embodiments, the invention provides a liquid-atomization device, comprising a hollow cylindrical or tubular body that is provided with two sets of perforated orifices along its circumference, one set at the lower portion of said hollow cylindrical body being suitable to be immersed in a liquid material, and another set at the upper portion of said hollow cylindrical body being suitable to be exposed to the environment, wherein said hollow cylindrical body is connectable to a source of compressed gas and is adapted to receive said compressed gas and to concurrently discharge said compressed gas through said sets of perforated orifices, and wherein the number of perforated orifices and the diameter of the orifices of said upper and lower sets are adapted to discharge desired flow rates of the compressed gas through said upper and lower sets. The shape of the hollow cylindrical body may be selected from straight, or bent in various spatial configurations. The shape of the hollow cylindrical body may be, for example, selected from circular, elliptical or coiled. The hollow cylindrical body may be made of an elastic material, such as rubber, or a plastic material; it may comprise a metallic material or a non-metallic material. The material may be a carbon-based material; it may be a composite material. The device according to the invention may employ a series of parallel hollow cylindrical bodies to enhance the atomization capacity. In one arrangement, an additional device generating bubbles is submerged into the liquid to be atomized in order to increase the amount of generated bubbles under said lower set of perforated orifices. Said liquid and/or said compressed gas may be heated or cooled. Additional planes may be introduced horizontally below and vertically near the hollow cylindrical body in order to constrict the generated bubbles, coming out of the orifices. The compression of the supplied gas may be reached by applying mechanical power. The invention, in one embodiment, provides a method for performing liquid-atomization, comprising i) providing a hollow body that is provided with two sets of orifices perforated in its walls along its circumference, one set at the lower portion of said body being suitable to be immersed in a liquid material, and another set at the upper portion of said body being suitable to be exposed to the atmospheric environment, wherein said body is connectable to a source of compressed gas and is adapted to receive said compressed gas and to concurrently discharge said compressed gas through said sets of the perforated orifices, and wherein the number of the perforated orifices and the diameter of the orifices of said upper and lower sets are adapted to discharge desired flow rates of the compressed gas through said upper and lower sets; ii) immersing the lower set of perforated orifices in a liquid material that is wished to be atomized; and iii) releasing said compressed gas into said hollow body. The shape of the hollow body is preferably tubular.

In one embodiment, the invention relates to a liquid-atomization device, comprising a tube that is provided with two sets of orifices along its circumference, where one set of orifices is located at the lower portion of the tube and another set is located at the upper portion of the tube. The tube can be made of elastic material (e.g., norprene rubber) or of any plastic/metallic/composite/non-metallic material and it can further be disposable. The lower portion of the tube is to be immersed in a liquid material, and the upper portion of the tube is to be exposed to the environment. The tube is connectable to a source of compressed gas, such as compressed air, and is adapted to receive said compressed gas and to concurrently discharge the compressed gas through the two sets of orifices. The number of orifices and the size of the orifices in each set are adapted to discharge desired flow rates of the compressed gas through said upper and lower sets. The tube can be straight or bent in various spatial configurations, e.g. circle, ellipse, coil etc., depending on the physical configuration of the apparatus and of the effect that it is desired to obtain. In one embodiment, the invention also relates to a liquid-atomization method, which exploits a physical phenomenon of breaking of liquid bubbles and thin liquid films generated from liquid to be atomized comprising: providing a device, comprising a cylindrical or spherical hollow body (e.g., tube, sphere) that is provided with two sets of orifices perforated in its walls along its circumference, one set at the lower portion of said hollow body to be immersed in a liquid material, and another set at the upper portion of said hollow body to be exposed to the environment, wherein said hollow body is connectable to a source of compressed gas and is adapted to receive said compressed gas and to concurrently discharge said compressed gas through said sets of orifices, and wherein the number and the diameter of the orifices of said upper and lower sets are adapted to discharge desired flow rates of the compressed gas through said upper and lower sets; immersing the lower set of orifices in a liquid material that is wished to be atomized; and releasing said compressed gas into said hollow body.

In one embodiment, the device and method of this invention apply mechanical impulse (e.g., pressure of compressed gas) on a thin layer of liquid material, breaking its surface-tension to disintegrate the said liquid layer into drops of a small diameter. In addition to the small size of the drop, there are many advantages in various embodiments of the invention, such as low-cost components, easy operation, and a low amount of energy that needs to be invested in the process, all of which will be further described.

Figure 1:
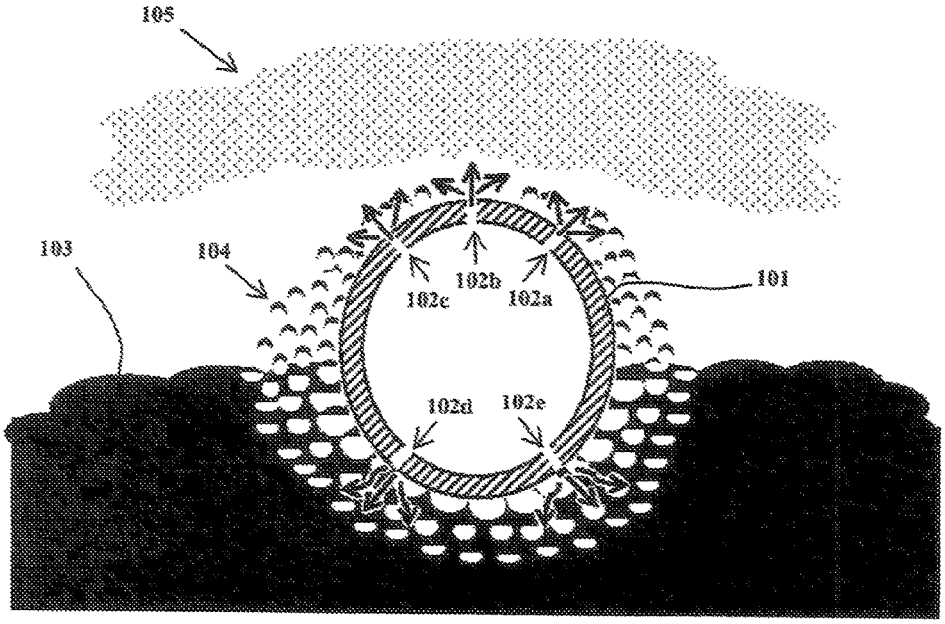
FIG. 1 is a cross-sectional view of a tube in the device according to some embodiments of the invention, in which the device comprises a hollow body having a cylindrical or tubular or torroidal or spherical shape.

FIG. 1 is a cross-sectional view of the tubing of a device according to one embodiment of the invention, where the device comprises tube 101, which is provided with orifices 102*a-e* perforated in the walls of tube 101. The bottom portion of tube 101 is immersed in liquid 103, and the upper portion of tube 101 is exposed to the atmosphere environment. The material from which tube 101 is produced can be of any kind that is suitable to be immersed in the liquid and can have some degree of elasticity, as described below.

Compressed gas (like air for example) is inserted into tube 101. When the compressed gas is in contact with orifices 102*a-e*, the pressure difference between the compressed gas and the outer environment tend to equalize, and the compressed gas is discharged through orifices 102*a-e* by a velocity increasing with said pressure difference. The material of tube (hollow body) 101 can possess some degree of elasticity to intensify and regulate the compressed gas discharge through the orifices, to prevent liquid backflow through the orifices and also to avert clogging of the orifices when atomizing suspensions and liquids of high viscosity. For tube 101 made of elastic material, such as norprene rubber, the size of orifices perforated in the tube walls, and the gas flow rate as well, depends on the pressure of the supplied compressed gas: the higher the gas pressure, the greater will be the size of the orifices and vice versa. Moreover, because of the pressure difference between the inner and outer sides of the tube 101, the internal parts of elastic orifices 102*a-e* that are in contact with the compressed gas will have larger sizes than their outer parts that are in contact either with liquid 103 or with the environment. Therefore, the elastic orifices will have shapes close to truncated cones (FIG. 2) and will act as nozzles, accelerating the flow of the discharging compressed gas and thereby intensifying the atomization process. In addition, the elasticity of tube 101 allows orifices 102*a-e* to function as check valves, preventing backflow from liquid and environment when the compressed gas is not supplied: due to elastic expansion of the tube material, orifices perforated in the tube walls by micron needle will have zero size (will be closed) if there is no excess pressure of the compressed gas inside tube 101. In case of clogging of the orifices during the operation, the elasticity of tube 101 will have advantages because it will allow enlarging the orifice sizes by supplying higher than operating pressure of the compressed gas and thus facilitating through-scavenging of the clogs.

When the compressed gas is released through the orifices immersed in the liquid like 102*d-e*, it creates bubbles that climb up and meet compressed gas released from the orifices 102*a-c*. Thin-walled bubbles 104 are broken by the gas jets released from orifices 102*a-c* into drops of very small size—atomized liquid 105—which are pushed away from the tube, providing a spray of the atomized liquid.

Figure 2:
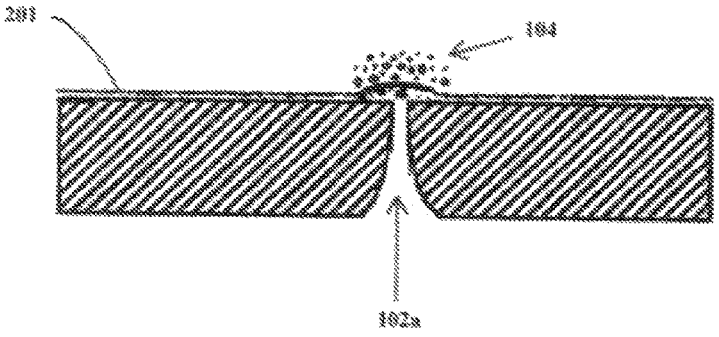
FIG. 2 is an enlarged view of one of the emerged orifices perforated in the walls of the tube of FIG. 1.

There are two sets of orifices perforated in tube walls—orifices 102*a-c* that are located at the upper portion of tube 101 and are exposed to the atmospheric environment, and orifices 102*d-e* that are located at the lower immersed portion of tube 101, exposed to the liquid material. The number of orifices in each set (lower or immersed set, and upper or emerged set) and the diameters of the orifices of each set are adapted to discharge desired flow rates of the compressed gas through said upper and lower sets and the skilled person will easily devise orifice configurations suitable for a specific need. The tube can be straight or bent in various spatial configurations, so that said longitudinal axis may have the shape of, e.g., circle, ellipse, coil etc. Along the tube, some sections may be entirely immersed or entirely emerged, but at least some sections must be partially immersed, having the longitudinal axis located in a plane parallel or identical to the interface between the liquid and the atmosphere, FIG. 2 is an enlarged view of orifice 102*a* perforated in tube wall 101 of FIG. 1, showing a layer 201 of bubbles 104 on top of orifice 102*a*. The relation between the height of layer 201 and the diameter of orifice 102*a* will determine the size of the drops of the atomized liquid, for example, a thicker layer would require a greater mechanical impulse of gas jet in order to reach the same results, and the mechanical impulse of gas jet coming out of orifice 102*a* is determined (among other parameters) by the size of the orifice.

According to experiments, the device can be of various shapes, as long as it comprises a tube that can contain a flow of compressed gas, orifices perforated in its walls as described, and it can be partially immersed in a liquid material. Two examples of possible shapes are a circular tube (such as a ring torus) and a linear tube.

The method of liquid atomization according to the invention exploits the physical phenomenon of breaking of liquid bubbles and thin liquid films that are generated from liquid to be atomized, and has relatively high energetic efficiency. Bubble walls may have a thickness of, for example, about 0.5 μm, and once the bubble is broken, it results in formation of droplets ranging from less than one micron to several microns in size. The flow rate of atomized droplets may be altered, among other parameters, by changing the pressure of the compressed gas in the device.

The material(s) from which the tube is produced is preferably an elastic polymer, for example norprene, but it may be other elastic material comprising, for example, plastic and/or metallic or non-metallic composite material.

The method of liquid atomization according to the invention is simple, and it can be easily adapted for different kinds of liquids by controlling the pressure of the compressed gas, the diameter and amount of the orifices, and the tubing elasticity, to adjust the system to different liquid viscosity, different capacity requirements, different droplet size demands, etc.

All the above description has been provided for the purpose of illustration and is not meant to limit the invention in any way. The invention presents significant advantages over the existing art by, for example, low-cost simple device construction, small diameter of the drops of the atomized liquid, high flow efficiency, suitability for broad range of liquids including solutions and dispersions of various chemical compositions, ability to operate at different temperatures, and minimal energy needed to operate the device. Moreover, different configurations can be provided. In one embodiment of the invention, the atomized liquid comprises at least one surfactant. The output capacity of the liquid atomizing system of the invention can be increased, for example, by arranging a plurality of tube sections within the interface plane between the liquid and the atmosphere, or near to it; a plurality of linear sections may be located in the plane in parallel, or the tube may be arranged into a spiral more or less filling the plane. Of course, other hollow bodies than tubes or tubing can be employed for releasing the pressurized gas to the liquid to be atomized, the bodies being for example elongated cylindrical bodies. The hollow body may have a spherical shape, approximately half submerged in the liquid to be atomized, particularly when a high capacity output is not needed.

The liquid atomizing system according to the invention comprises a means for continually generating bubbles, and a means for breaking said bubbles while moving them to one direction. The preferred embodiment of the atomizing system of the invention comprises a perforated hollow cylindrical body connected to compressed gas supply and half immersed in the liquid to be atomized, whereas the means for generating bubbles comprises the perforations in the immersed part of the hollow body, and the means for breaking bubbles comprises the perforations in the emerged part of the hollow body. The pressurized gas may comprise air, nitrogen, or other gas of needed purity, inertness, and cost. The liquid and/or the compressed gas may be heated or cooled before or during the atomization process.

In one embodiment of the invention, partition members, for example in the form of inert planes, are introduced horizontally below and vertically near the hollow cylindrical body 101, in order to constrict the generated bubbles, coming out of the orifices 102*e-d*.

The present liquid-atomization method utilizes disintegration of thin liquid films on the interface between the liquid and environment. The material composition, microstructure and properties of liquid near the interface are known to be different from those in the bulk. Moreover, bubbles, generated from the orifices 102*d* and 102*e* (FIG. 1), rise to the surface 103 and enable the effects of particle and ion flotation which additionally impact the material composition, microstructure and properties of the liquid near its interface 103. In one embodiment of the invention, the droplets generated by the present liquid-atomization method will have the material composition, microstructure and properties which are different from those in the bulk liquid.

The present liquid-atomization method may simultaneously produce droplets of different sizes. Conducting the generated droplets through an additional vertical/inclined tube placed above tube 101 (FIG. 1) will result in fractionation of the droplet distribution: the size of the obtained droplets coming out of this additional vertical/inclined tube will depend on the diameter of the vertical/inclined tube.

The system of the invention enables the generation of sprays of fine droplets by disintegrating thin liquid films using gas jets, in a simple, low cost, low energy, ecologically friendly, and high-throughput way; micron and submicron droplets and nano-structures may be provided by the new system for technologies employing liquid-atomization, particle microstructures, encapsulation, and coating.

EXAMPLES

The system for liquid atomization according to the invention was examined in an experimental arrangement as schematically shown in FIG. 3. In a vessel, 1, norprene tubing, 2, was placed to an aqueous liquid. The tubing was floating on the liquid surface, and it was connected to pressurized air, 0.5 to 5.5 atm, provided with a filter, 3, and a pressure regulator, 4, the air flow being between 10 and 100 l/min. The tubing was perforated with a needle having a diameter of 0.6 mm, approximately the same number of orifices being above and below the liquid surface (liquid/air interface); the number of orifices being, in various experiments, between 10 and 32 per cm, the tubing length being between 1.5 and 30 cm, the tubing outer diameter 11 or 12 mm and inner diameter between 6 and 8.4 mm. The droplets formed in vessel 1 rose to an exit located between laser emitter 7 and acceptor 6 of a drop analyzer, Malverin Spraytec Device 5. The experiments were performed at a temperature of 22-23° C.

Figure 4:
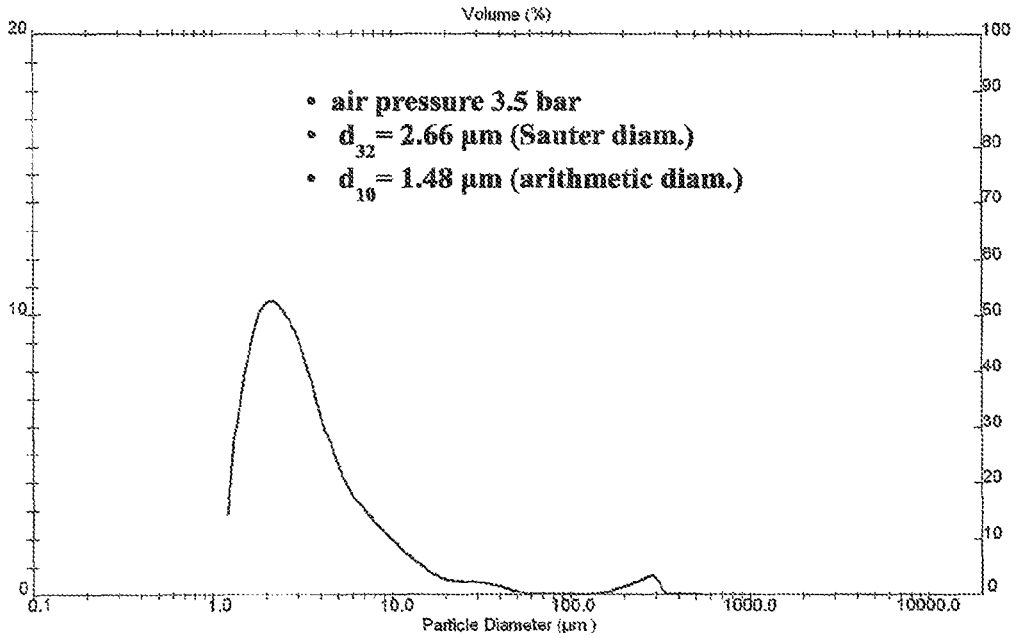
FIG. 4 shows droplet diameter distribution for two embodiments of liquid atomization according to the invention.
Figure 4:
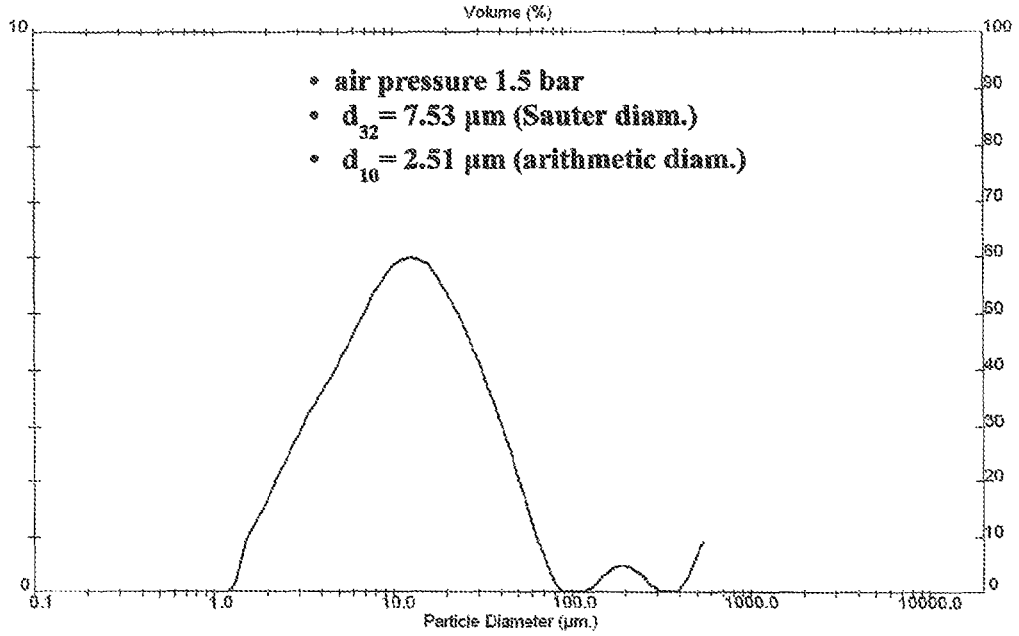
Figure 5:
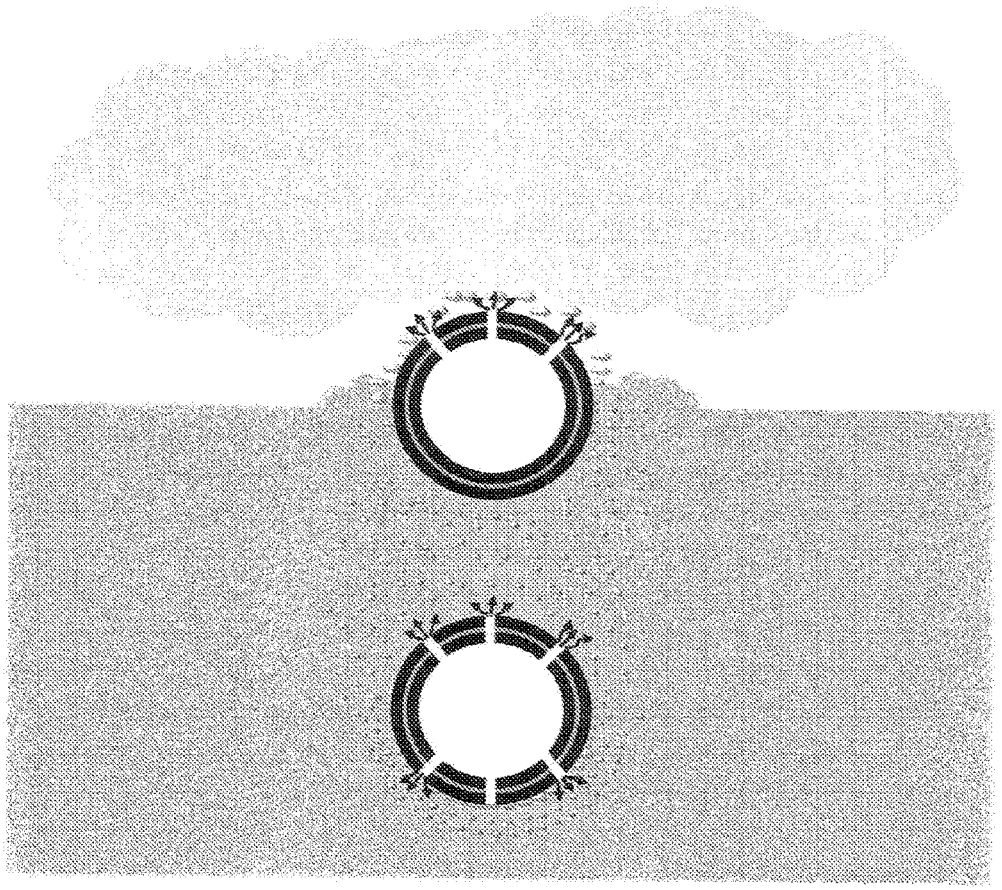
FIG. 5 shows two hollow bodies in a system for liquid atomization in one embodiment of the invention; both bodies are connected to compressed gas and the gas is discharged through their perforated walls, bubbles come to liquid surface towards upper hollow body and a liquid film is formed around it, gas jets coming out through the orifices of the perforated walls of the upper body disintegrate this liquid film into a mist of droplets.
Figure 6:
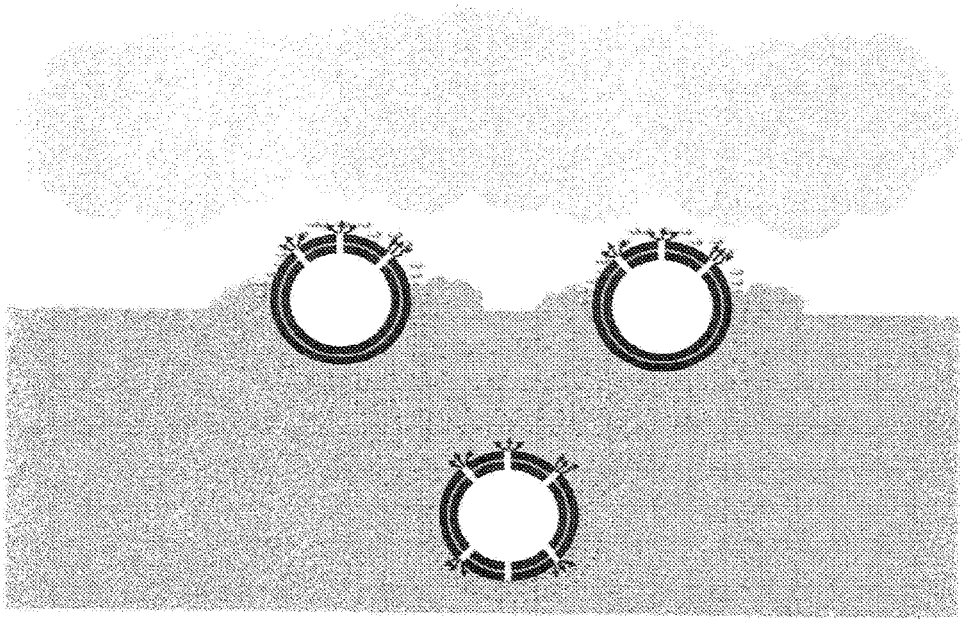
FIG. 6 shows hollow bodies in a system for liquid atomization similar to FIG. 5, but in order to increase the efficiency and droplet flow rate, two upper hollow bodies instead of one disintegrate liquid films into mist in this embodiment.
Figure 7:
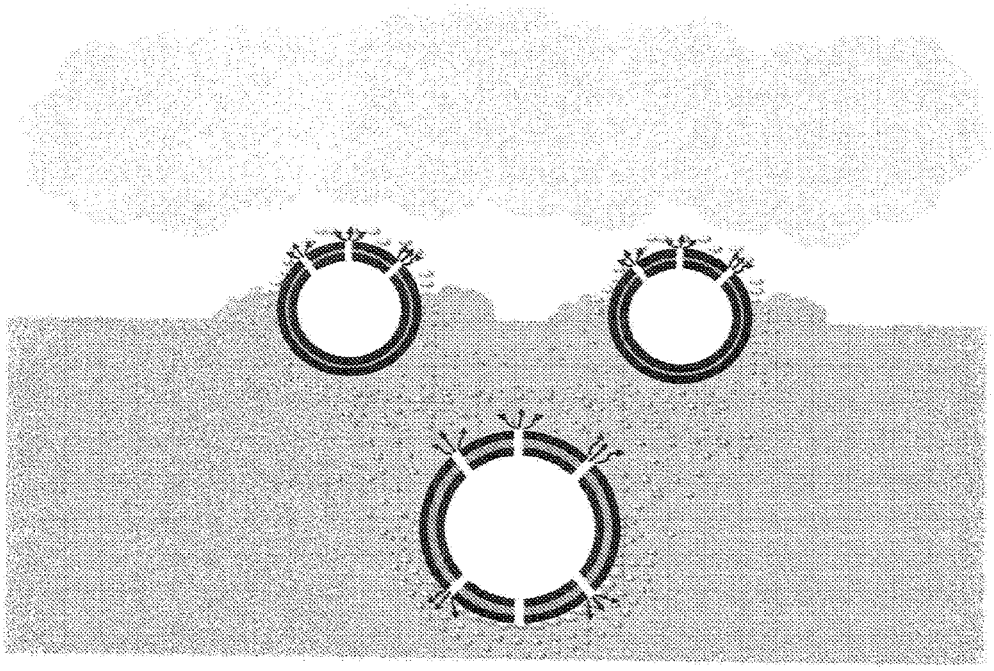
FIG. 7 shows hollow bodies in a system for liquid atomization similar to FIG. 6, but in order to increase the production of bubbles and droplet flow rate, the lower hollow body has bigger size than two upper bodies.
Figure 8:
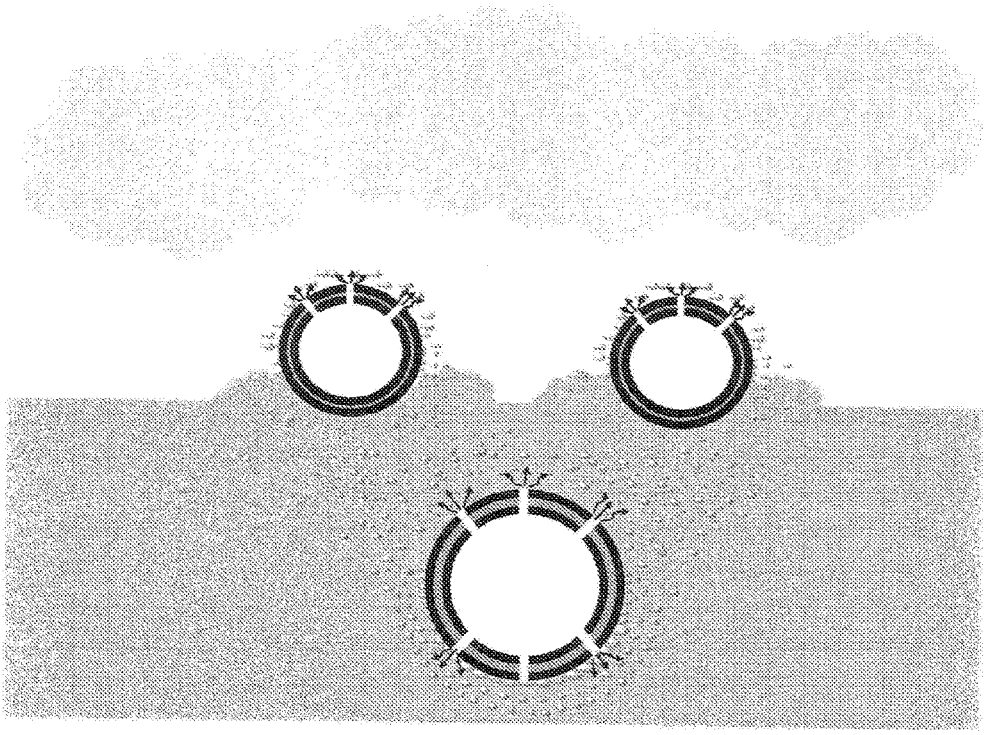
FIG. 8 shows hollow bodies in a system for liquid atomization similar to FIG. 7, but upper hollow bodies are not submerged and are floating over the liquid surface in this embodiment.
Figure 9:
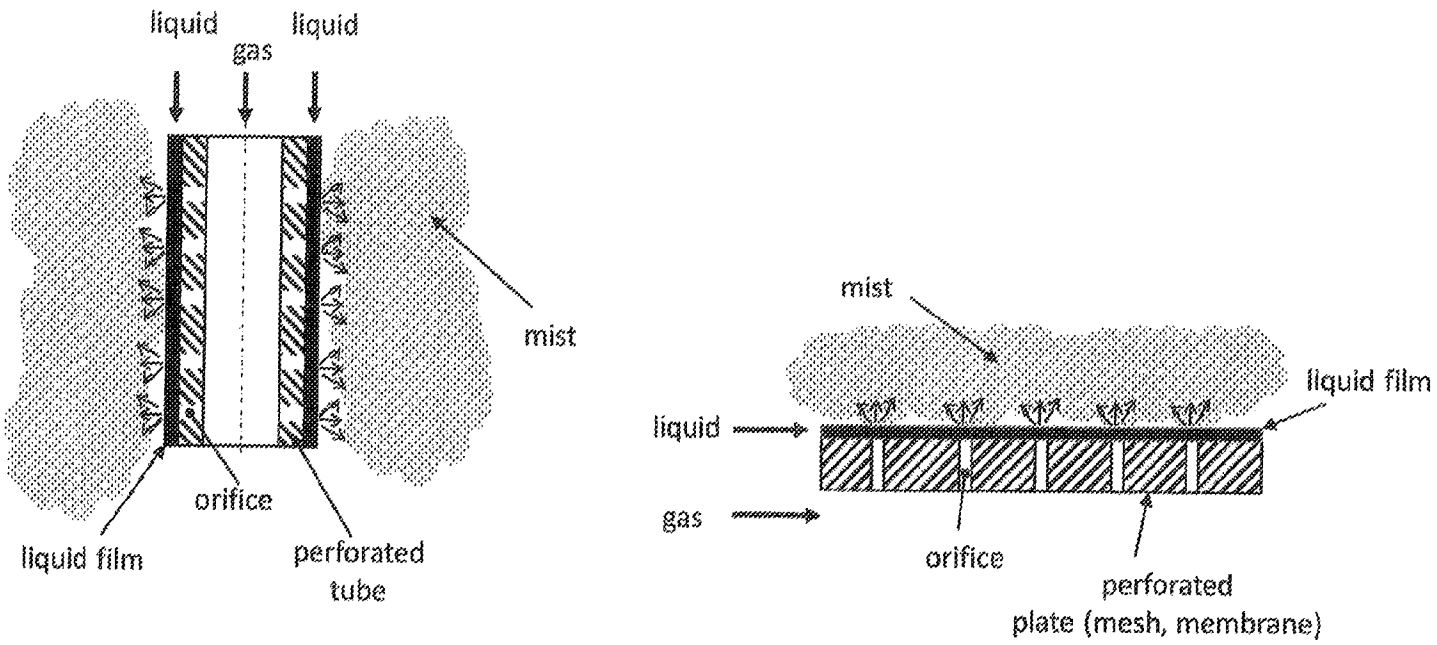
FIG. 9 shows two embodiments of an atomizing system according to the invention which can be used for spraying of fuel in internal combustion engine or gas turbine; outer surface of a perforated hollow body (such as cylindrical tube on the left) or one side of perforated plate (such as mesh or membrane on the right) is covered with a thin liquid film; compressed gas is supplied inside the hollow body or over the other side of the hollow perforated plate; gas jets coming from the orifices disintegrate the liquid film into a mist of droplets.

It was found that the amount of the formed mist linearly increased with increasing air pressure, being in one arrangement, for example 1 liter of liquid atomized per hour per 1 meter of tubing at the overpressure of 1 atm (relatively to the atmospheric pressure). The diameter of the droplets, as obtained from the Spraytec device was, ranged in various experiments between 1 and 100 μm. In one arrangement, for example, the Sauter diameter was 2.66 μm at air pressure of 3.5 atm and 7.53 μm at pressure of 1.5 atm, as seen in the distributions shown in FIG. 4, in which the X-axis shows droplet diameter and the Y-axis the fraction in %.

The process of the bubble formation near to the immersed orifices and droplet formation near the emerged orifices was observed by the inventors by means of a fast camera (10,000 fps) and slow motion analysis. The mist formation can be affected by the process parameters; for example, higher diameter of the perforation needle provides greater droplets; similarly, the thinner is film which covers the emerged orifices, the smaller are the formed droplets; the greater is the air pressure, the smaller are the droplets.

Beside circular tubing, also straight arrangements were examined. Beside water, also other liquids were examined in the atomization system of the invention, including aqueous solutions. For example, 0.5% NaCl solution was atomized for 75 minutes, in one experiment; average flow rate of the droplets (mist) was 0.32 l/hr. Conductivity measurement showed a 20% increase of the NaCl concentration in the mist than in the original liquid mist; this demonstrated that the system of the invention enables to modify the concentrations of the components in the mist relatively to the original liquid, when needed, which can have a great potential in various technological fields and in pharmaceutical applications.

The device and the method of the invention allow obtaining sprays with very fine droplets at high throughput. The system is low cost, scalable, environmental friendly, and suitable for different liquids including biological and pharmaceutical materials, and thus will be useful in many applications.

The invention claimed is:

1. A liquid-atomization device, comprising a hollow body having a closed surface provided with a plurality of orifices exhibiting a size of less than 1 mm, the body suitable to be partially submerged in a liquid while a first part of the orifices being immersed in said liquid under the interface between said liquid and a gas above it, and a second part of the orifices being emerged from said liquid above said interface, said body comprising position means for regulating the relative position of the body and the interface, said body being connected to a source of compressed gas and adapted to receive said compressed gas selected from air, nitrogen, and aerosol propellants, the diameter and the number of the orifices being adapted to discharge desired flow rates of said gas out of the body, the gas discharged from the immersed orifices providing a jet of liquid particles to the space above said interface to form a film to be continuously transformed by the gas from said emerged orifices to liquid droplets smaller than said liquid particles, and forming a mist of droplets, the first subset part of orifices thus delivering the liquid to be atomized and the second part of the orifices transforming the liquid to mist, wherein the position means comprising elements selected from the group consisting of floaters, weights, and sensors.

2. The device of claim 1, wherein the hollow body has a shape selected from the group consisting of cylindrical, tubular, torroidal, spherical, conical, parallelepipedal, and a combination thereof.

3. A device according to claim 2, wherein a plurality of parallel hollow bodies is utilized to enhance the atomization capacity.

4. A device according to claim 1, wherein the hollow body is made of a material selected from polymer, metal, composite, and a combination thereof.

5. A device according to claim 1, wherein the hollow body is made of an elastic material.

6. A device according to claim 1, wherein one or several of additional devices generating bubbles are submerged into the liquid to be atomized in order to increase the amount of generated bubbles under said interface.

7. A device according to claim 1, wherein liquid and/or compressed gas are heated or cooled.

8. The device of claim 1, wherein said position means ensures the desired ratio between the numbers of the orifices in said first part and in said second part.

* * * * *